US007033141B2

(12) United States Patent
Hong et al.

(10) Patent No.: US 7,033,141 B2
(45) Date of Patent: Apr. 25, 2006

(54) LINEAR COMPRESSOR AND METHOD FOR CONTROLLING THE SAME

(75) Inventors: Eon Pyo Hong, Seoul (KR); Kyeong Bae Park, Seoul (KR); Tae Hee Kwak, Inchun-si (KR); Ki Chul Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 18 days.

(21) Appl. No.: 10/956,054

(22) Filed: Oct. 4, 2004

(65) Prior Publication Data

US 2005/0152788 A1 Jul. 14, 2005

(30) Foreign Application Priority Data

Jan. 8, 2004 (KR) ..... 10-2004-0001312

(51) Int. Cl.
*F04B 49/06* (2006.01)

(52) U.S. Cl. ..... 417/45; 417/417; 310/23

(58) Field of Classification Search ..... 417/415–418; 310/12, 13, 15, 23, 27, 29, 30
See application file for complete search history.

(56) References Cited

U.S. PATENT DOCUMENTS 3,629,674 A * 12/1971 Brown ..... 417/417
4,127,889 A * 11/1978 Asano et al. ..... 310/13
4,374,330 A * 2/1983 Fey ..... 417/417
4,761,575 A * 8/1988 Reder et al. ..... 310/29
2005/0189824 A1* 9/2005 Jeong et al. ..... 417/417

* cited by examiner

*Primary Examiner*—Michael Koczo, Jr.
(74) *Attorney, Agent, or Firm*—Birch, Stewart, Kolasch & Birch, LLP

(57) ABSTRACT

A linear compressor and a method for controlling the same. The linear compressor automatically short-circuits part of a coil having no power-supply voltage in order to substantially prevent an excessive stroke from being generated when the linear compressor is initially operated. The linear compressor includes a piston contained in a cylinder, for executing reciprocating linear motion to suck or discharge a refrigerant, a linear motor for providing the piston with driving power to allow the piston to execute the reciprocating motion, and a power-supply unit for providing the linear motor with a power-supply voltage, and performing an automatic short-circuit function to prevent an excessive stroke from being generated during an initial operation stage of the linear motor. Therefore, the linear compressor can reduce noise caused by the excessive stroke generated during the initial operation stage of the linear compressor, resulting in increased efficiency and convenience of the linear compressor.

14 Claims, 5 Drawing Sheets

LINEAR COMPRESSOR AND METHOD FOR CONTROLLING THE SAME

This Nonprovisional application claims priority under 35 U.S.C. § 119(a) on Patent Application No(s). 10-2004-0001312 filed in Korea, Republic of on Jan. 8, 2004, the entire contents of which are hereby incorporated by reference.

BACKGROUND OF THE INVENTION

1. Field of the Invention

The present invention relates to a linear compressor and a method for controlling the same, and more particularly to a linear compressor which can automatically short-circuit part of a coil having no power-supply voltage in order to substantially prevent an excessive stroke from being generated when the linear compressor is initially operated, and a method for controlling the same.

2. Description of the Related Art

Typically, compressors are machines used to compress fluid, such as air, refrigerant gas, etc. Among them, in case of a linear compressor, driving power of a linear motor is transmitted to a piston of the compressor so that the piston rectilinearly reciprocates inside a cylinder, thereby sucking and compressing the refrigerant gas. The linear compressor generally comprises a compressing unit for compressing the refrigerant gas, and a driving unit for providing the compressing unit with the driving power to drive the compressing unit.

FIG. 1 is a cross sectional view illustrating a conventional linear compressor.

As shown in FIG. 1, the conventional linear compressor comprises: a power-supply unit (not shown) for providing a power-supply voltage; a hermetic casing 1, to one side of which is connected a pipe (not shown) for use in the suction of a refrigerant; a cylinder 2 fixedly disposed inside the hermetic casing 1, and internally defining a compression space for use in the compression of the refrigerant; a piston 3 installed to rectilinearly reciprocate inside the cylinder 2 for sucking and compressing the refrigerant in the compression space; and a linear motor 6 connected to a front end of the piston 3 for providing the piston 3 with driving power to allow the piston 3 to rectilinearly reciprocate.

The linear compressor further comprises: a suction valve 4 installed at a rear end of the piston 3 for sucking the refrigerant into the compression space defined between the cylinder 2 and the piston 3; and a discharge valve assembly installed at a rear end of the cylinder 2 for discharging the refrigerant from the compression space to the outside.

In this case, the linear motor 6 consists of a stator, and a mover. The stator comprises a cylindrical outer core 6*a*, a cylindrical inner core 6*b* loosely inserted in the outer core 6*a* to form a predetermined gap therebetween, and a coil assembly 6*c* positioned between the outer core 6*a* and the inner core 6*b*.

The mover comprises a magnet 6*d* positioned between the inner core 6*b* and the coil assembly 6*c* in a rectilinearly reciprocable manner, and a magnet frame 6*e* used to connect and fix the magnet 6*d* and the piston 3 to each other for allowing rectilinear reciprocating motion of the magnet 6*d* to be transmitted to the piston 3.

With the conventional linear compressor configured as stated above, upon receiving a power-supply voltage from the power-supply unit, a current flows in a coil of the coil assembly 6*c*, and creates a magnetic field around the coil assembly 6*c*. As the magnetic field interacts with the magnet 6*d*, inducing rectilinear reciprocating motion of the magnet 6*d*.

In this case, the magnet frame 6*e* also rectilinearly reciprocates along with the magnet 6*d*, allowing the piston 3 to rectilinearly reciprocate inside the cylinder 2.

At the same time the piston 3 rectilinearly reciprocates inside the cylinder 2, the refrigerant gas enters into the hermetic casing 1 according to operations of the suction valve 4 and the discharge valve 5. The refrigerant gas is first sucked into the cylinder 2 through an inner through-bore of the inner core 6*b* and a refrigerant passage of the piston 3, and compressed in the compression space inside the cylinder 2. Then, the compressed high-pressure and high-temperature refrigerant gas is discharged from the cylinder 2, and finally discharged to the outside of the hermetic casing 1 through a discharge pipe (not shown).

However, in the above-identified linear compressor, if the power-supply voltage is applied to only part of the coil when the power-supply unit is initially connected, an induced current is generated in the remaining part of the coil having no power-supply voltage, unavoidably creating a force hindering the motion of the piston 3. Such a force excessively increases the stroke of the piston 3, causing the piston 3 to collide with the discharge valve 5.

The induced current will hereinafter be described in detail.

Typically, if a coil is fixed in place and a magnet located around the coil is moved, or if the magnet is fixed in place and the coil is moved, a current is generated in the coil. Further, when the magnet is moved close to the coil or far from the coil, or when polarity of the magnet is changed, the flow direction of the current generated in the coil is changed.

Such a current induction phenomenon caused by relative motions between the coil and the magnet is called electromagnetic induction, and electromotive force generated in both ends of the coil is called induced electromotive force. In this case, the current flowing in the coil under the influence of the induced electromotive force is called an induced current.

If an ammeter is connected to a closed circuit connecting the power-supply unit to the coil, the ammeter's scale does not immediately indicate a specific numerical value, and gradually moves until reaching a predetermined numerical value due to the induced current. If the intensity of the induced current is changed, the strength of a magnetic field produced around the coil is also changed.

In more detail, if the intensity of the current flowing in the coil is changed, magnetic flux flowing in the coil is also changed, such that the induced electromotive force is generated. In this way, due to the change of the current flowing in the coil, the induced electromotive force is generated in the coil, and at the same time, the induced current flows in the coil. This phenomenon is called self-induction, and the generated induced electromotive force is represented by the following Equation 1:

$$V = -L\frac{\Delta I}{\Delta t} \qquad \text{[Equation 1]}$$

where "L" serving as a proportional constant is a self-induction coefficient. The self-induction coefficient is proportional to a variety of factors, for example, magnetic permeability of an iron core inside the coil, the number of turns of the coil, and a cross section of the coil, and is inversely proportional to the length of the coil.

Therefore, as can be seen from the above Equation 1, in part of the coil having no power-supply voltage is generated the induced current flowing in an opposite direction of the current, which flows in the remaining part of the coil connected to the power-supply unit, and this generates a larger stroke than the existing stroke, resulting in a considerable increase in noise during operation of the linear compressor.

In order to solve the above problem, it has been proposed to install a drive capable of adjusting the amount of current applied to the motor. Although such a solution can reduce the amount of current required when the linear compressor is initially operated, it requires additional control parts, increasing manufacturing costs of the linear compressor.

SUMMARY OF THE INVENTION

Therefore, the present invention has been made in view of the above problems, and it is an object of the present invention to provide a linear compressor which can automatically short-circuit part of a coil disconnected from a power-supply unit when the linear compressor is initially operated, and cancel the connection of the short-circuited coil after the lapse of a predetermined time, thereby substantially preventing an excessive stroke from being generated during an initial operation stage of the linear compressor, and a method for controlling the same.

In accordance with one aspect of the present invention, the above and other objects can be accomplished by the provision of a linear compressor comprising: a piston contained in a cylinder, and executing rectilinear reciprocating motion to suck or discharge a refrigerant; a linear motor for providing the piston with a driving power to allow the piston to execute the rectilinear reciprocating motion; and a power-supply unit for providing the linear motor with a power-supply voltage, and performing an automatic short-circuit function to substantially prevent an excessive stroke from being generated during an initial operation stage of the linear motor.

Preferably, the linear motor includes a coil for creating a magnetic field of a predetermined magnitude in its peripheral area, upon receiving a current applied according to an entry mode, and the coil may include one or more terminals used to classify the coil into several parts according to a predetermined length for allowing the intensity of the magnetic field generated around the coil to be gradually changed according to the entry mode.

Preferably, the power-supply unit may be designed so that it transmits the power-supply voltage generated from a commercial AC power source to the coil according to the entry mode, and automatically short-circuits the terminals disconnected from the AC power source, or cancels the automatic short-circuited status of the terminals, during an initial operation stage of the linear motor.

In accordance with another aspect of the present invention, there is provided a method for controlling a linear compressor, comprising the steps of: a) transmitting a power-supply voltage to the linear compressor designed to compress fluid, such as air and refrigerant gas, etc., and to discharge the compressed fluid; b) automatically short-circuiting part of a coil having no power-supply voltage to form a closed circuit suitable to substantially prevent an excessive stroke from being generated when the linear compressor is initially operated upon receiving the power-supply voltage; and c) automatically canceling the automatic short-circuited status of the terminals after the lapse of a predetermined time.

Preferably, in the step c), if load is generated due to a pressure difference between suction and discharge sides of the linear compressor, the automatic short-circuited status of the terminals is canceled.

The linear compressor, according to the present invention as stated above, includes the power-supply unit for providing the linear motor with the power-supply voltage. The power-supply unit is designed to automatically short-circuit part of the coil disconnected from the power-supply unit during the initial operation stage of the linear compressor, and to cancel the automatic short-circuited status of the coil after the lapse of a predetermined time, such that it is possible to reduce noise caused by the excessive stroke generated during the initial operation state of the linear compressor, resulting in increased efficiency and convenience of the linear compressor.

Further, according to the method for controlling the linear compressor, part of the coil having no power-supply voltage is automatically short-circuited, and the automatic short-circuited status of the coil is canceled after the lapse of a predetermined time, such that it is possible to substantially prevent the excessive stroke from being generated during the initial operation time of the linear compressor, resulting in increased efficiency and convenience of the linear compressor, as well as reliability thereof in compressing operation thereof.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, a preferred embodiment of a linear compressor and a method for controlling the same according to the present invention will be explained with reference to the accompanying drawings.

Although there exist a plurality of embodiments describing a linear compressor and a method for controlling the same according to the present invention, hereinafter, only a few preferred embodiments will be described in detail. In the following description, a detailed description of known functions and basic configurations will be omitted for the convenience of description.

First, explaining the configuration of the linear compressor according to the present invention in brief, the linear compressor comprises a piston, and a linear motor connected to the piston for rectilinearly reciprocating the piston.

The linear motor includes a stator, and a mover. To one side of the mover is connected a fixing portion of the piston. If the mover rectilinearly reciprocates under the influence of a magnetic field produced in the stator, the piston connected to the mover rectilinearly reciprocates inside a cylinder.

In this case, the stator comprises an outer core taking the form of a stack, an inner core taking the form of a stack and loosely inserted in the outer core to form a predetermined gap therebetween, and a coil assembly mounted to the outer core for producing a magnetic field in its peripheral region upon receiving a power-supply voltage. The coil assembly is internally mounted with a coil for producing the magnetic field upon receiving the power-supply voltage.

The mover comprises a magnet positioned between the inner core and the outer core so that it is fixed to the piston.

Figure 1:
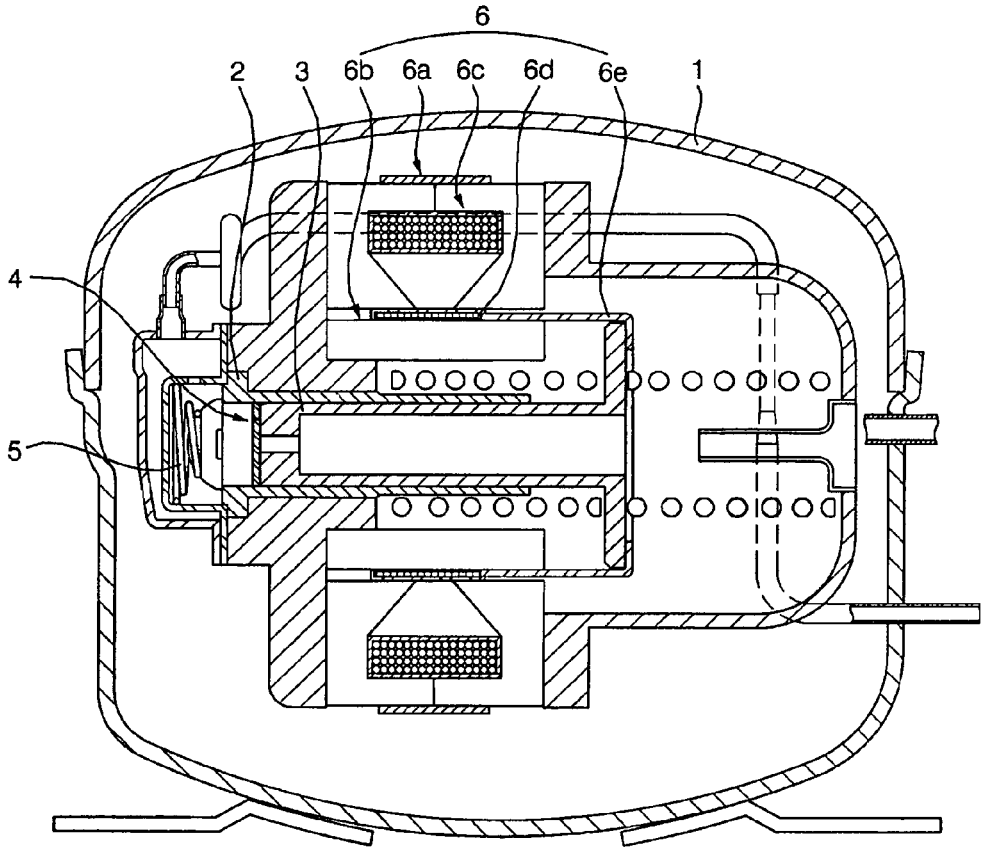
FIG. 1 (Prior Art)
FIG. 1 is a cross sectional view illustrating a conventional linear compressor.
Figure 2:
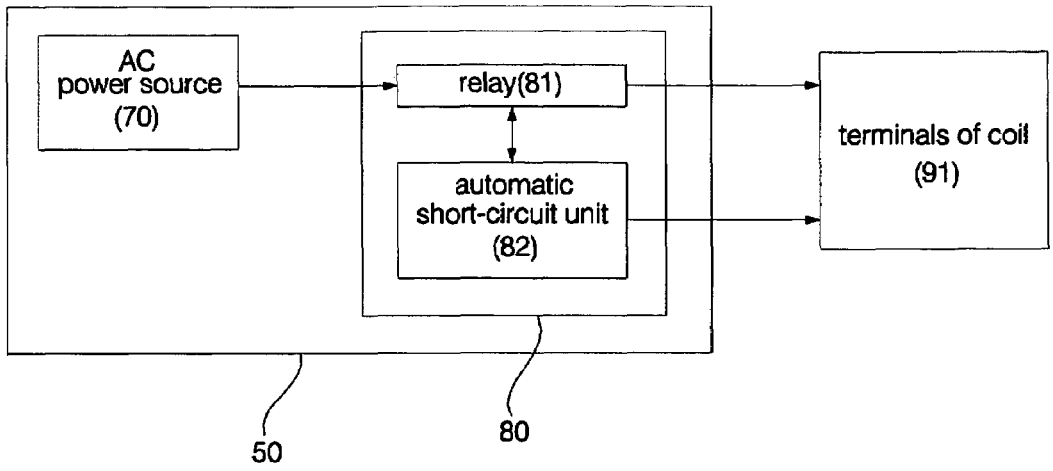
FIG. 2 is a block diagram illustrating a power-supply unit for use in a linear compressor in accordance with a preferred embodiment of the present invention.
Figure 3A:
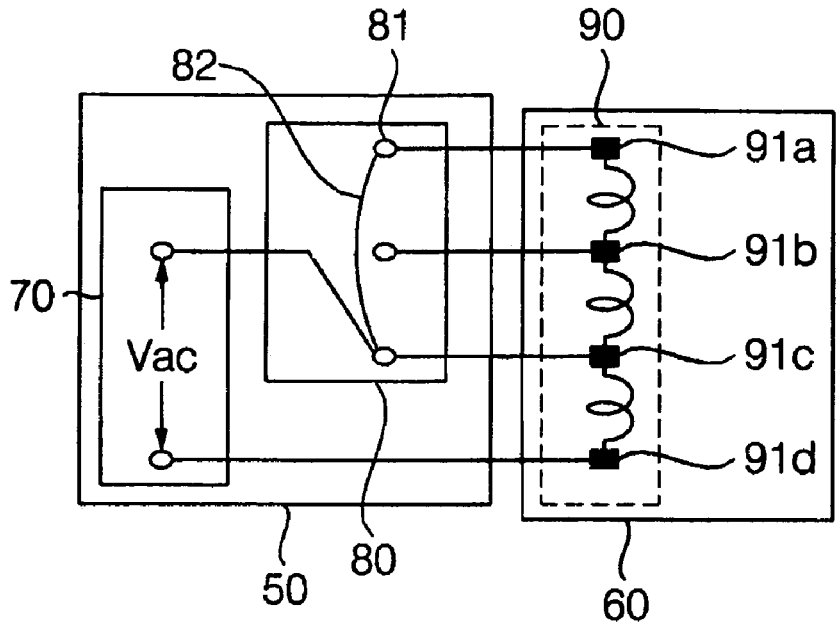
FIGS. 3*a* and 3*b* are circuit diagrams, respectively, illustrating different connected states of the power-supply unit and a coil during an initial operation stage of the linear compressor in accordance with the preferred embodiment of the present invention.
Figure 3B:
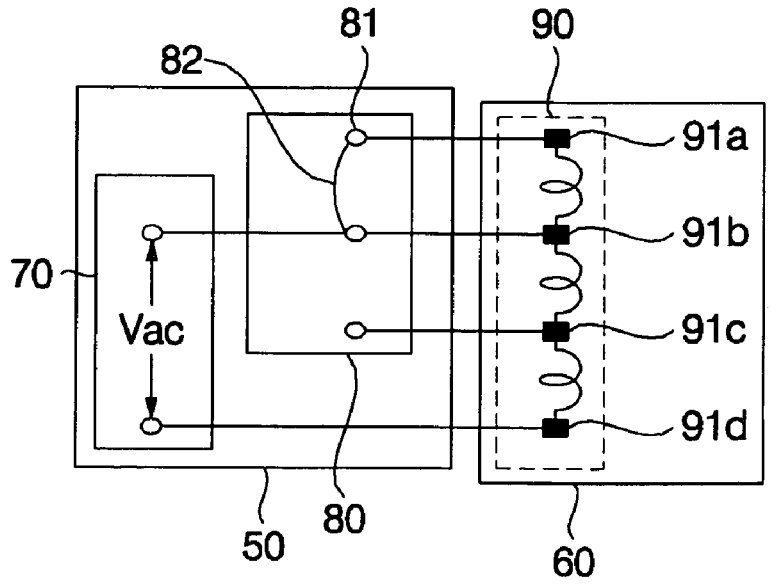
Figure 4A:
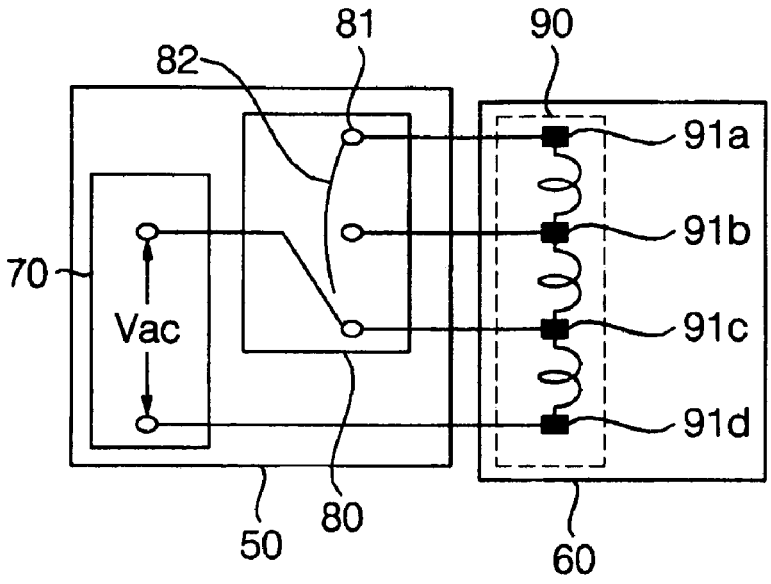
FIGS. 4*a* and 4*b* are circuit diagrams, respectively, illustrating different connected states of the power-supply unit and the coil during a normal operation stage of the linear compressor in accordance with the preferred embodiment of the present invention.
Figure 4B:
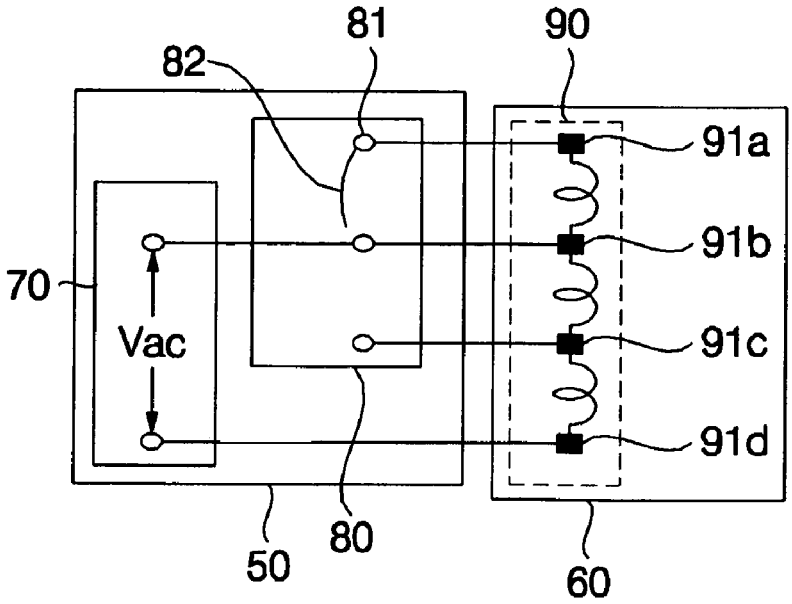

FIG. 2 is a block diagram illustrating a power-supply unit for use in the linear compressor in accordance with a preferred embodiment of the present invention. FIGS. 3*a* and 3*b* are circuit diagrams, respectively, illustrating different connected states of the power supply-unit and a coil during an initial operation stage of the linear compressor in accordance with the preferred embodiment of the present invention. FIGS. 4*a* and 4*b* are circuit diagrams, respectively, illustrating different connected states of the power-supply unit and the coil during a normal operation stage of the linear compressor in accordance with the preferred embodiment of the present invention.

The linear compressor according to the present invention comprises a power-supply unit 50. The power-supply unit 50 provides a linear motor 60 with a power-supply voltage, and functions to substantially prevent an excessive stroke from being generated when the linear motor 60 is initially operated.

The power-supply unit 50 includes an AC power source 70 for providing a commercial AC power-supply voltage from the outside, and a stroke controller 80. The stroke controller 80 serves to transmit the AC power-supply voltage generated from the AC power source 70 to a coil 90, and to short-circuit part of the coil 90 disconnected from the AC power source 70, such that it can substantially prevent an excessive stroke from being generated when the linear motor 60 is initially operated.

The stroke controller 80 includes at least one relay 81 and an automatic short-circuit unit 82. The relay 81 is connected to a corresponding part of the coil 90 according to the magnitude of AC power-supply voltage transmitted thereto. The automatic short-circuit unit 82 is connected to the relay 81 for performing automatic short-circuit of the remaining part of the coil 90, which is disconnected from the relay 81 and thus has no AC power-supply voltage.

In this case, a coil assembly 65 comprises the coil 90, and terminals for classifying the coil 90 into several parts according to a predetermined length for allowing the intensity of the magnetic field produced around the coil 90 to be gradually changed according to an entry mode.

The terminals include a ground terminal 91*d*, and first to third terminals 91*a* to 91*c*. With such a configuration, according to load or transmitted power-supply voltage, the amount of current transmitted to the linear motor 60 is changed, enabling control of a reciprocating movement distance, namely, a stroke, of the piston.

That is, in the linear motor 60, the stroke of the piston increases as the power-supply voltage transmitted from the outside increases. On the contrary, as the number of turns of the coil 90 increases, the stroke of the piston decreases.

Meanwhile, the voltage of electricity supplied from an electric-power source is applied to the coil 90 with a deviation of approximately 15%.

For example, on the assumption that a conventional applied voltage is 220V, if a voltage of less than approximately 205V is applied, the stroke of the piston is extremely reduced. In order to compensate for such a reduction in the stroke of the piston, a low mode is set to reduce the number of turns of the coil 90. On the contrary, if a voltage of more than approximately 235V is applied, the stroke of the piston is abruptly increased. In order to restrict such an abrupt increase of the stroke, a high mode is set to increase the number of turns of the coil 90. In addition, if a voltage of 220V is applied, a middle mode is set.

For this, the first terminal 91*a* is connected to the relay 81 in the high mode, the second terminal 91*b* to the relay 81 in the middle mode, and the third terminal 91*c* to the relay 81 in the low mode.

If the relay 81 is connected to a selected one of the terminals 91*a*, 91*b*, and 91*c*, the automatic short-circuit unit 82 automatically connects and short-circuits one of the remaining terminals disconnected from the relay 81 to the selected terminal, thereby substantially preventing an excessive stroke from being generated when the linear motor 60 is initially operated.

As well known, when the low mode or middle mot is set according to the power-supply voltage transmitted to the linear compressor during the initial operation state of the linear compressor, if there exists substantially no load inside the linear compressor, it results in the generation of the stroke. Therefore, the terminals of the coil 90 disconnected from the power-supply unit are short-circuited to form a closed circuit, such that the number of turns of the coil 90 increases, resulting in a reduction of the stroke.

Even when an induced current, which is generated in the coil 90 disconnected from the power-supply unit, acts to prevent movement of a magnet associated with the coil 90, the stroke is excessively generated, but such an induced current can be effectively removed using the above-identified method.

Now, respective entry modes of the linear compressor will be explained in detail.

If a voltage of 205V, lower than a conventional applied voltage, is transmitted to the linear compressor, and thus the linear compressor is set in the low mode, as shown in FIG. 3*a*, the relay 81 is connected to the third terminal 91*c*. In this case, the automatic short-circuit unit 82 automatically connects the first terminal 91*a*, disconnected from the relay 81, to the third terminal 91*c*.

When the first terminal 91*a* and the third terminal 91*c* are short-circuited to form a closed circuit, it temporarily increases the number of turns of the coil 90 to which the power-supply voltage is transmitted, resulting in a reduction in the stroke. This also allows the power-supply voltage to be transmitted to the overall coil 90, thereby preventing the generation of the induced current.

If a conventional power-supply voltage, for example, 220V, is applied, as shown in FIG. 3*b*, the relay 81 is connected to the second terminal 91*b*, and the automatic short-circuit unit 82 automatically short-circuits the first and second terminals 91*a* and 91*b* to form a closed circuit, thereby restricting the stroke.

In this case, since such an automatic short-circuited status obtained by the automatic short-circuit unit 82 has a purpose of preventing a phenomenon caused when the linear compressor is initially operated, the automatic short-circuited status has to be canceled to enable normal operation of the linear compressor 60 after the lapse of a predetermined time.

Therefore, after the lapse of a predetermined time, the automatic short-circuit unit 82 automatically cancels the short-circuited status as shown in FIGS. 4*a* and 4*b*. This is achieved at a time of detecting load generated due to a pressure difference of a refrigerant gas between suction and discharge sides of the linear compressor 60.

Figure 5:
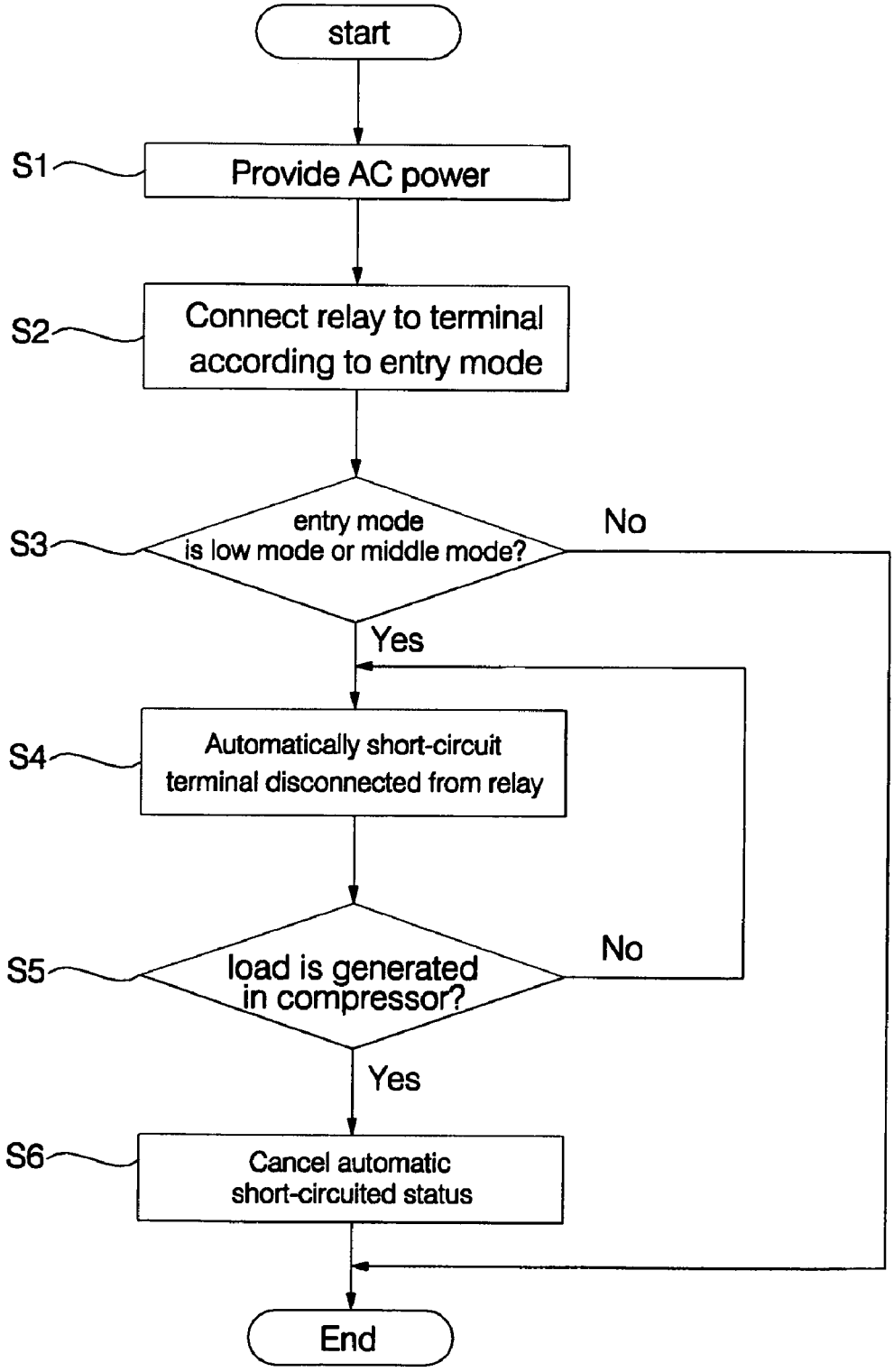
FIG. 5 is a flow chart illustrating operating sequences of the linear compressor in accordance with the preferred embodiment of the present invention.

The operation of the above-identified linear compressor according to the present invention will hereinafter be described with reference to FIG. 5.

First, an AC power-supply voltage is applied to the linear compressor (step S1).

In this case, if the voltage applied to the linear compressor has a value lower than a conventional value, for example, a value of 205V, in order to compensate for such an applied voltage, the low mode is set so that the relay 81 connected to the power-supply unit is connected to the third terminal 91*c*.

If the applied voltage has the conventional value, the middle mode is set so that the relay 81 is connected to the second terminal 91*b*. Further, if the applied voltage has a value higher than the conventional value, for example, a value of 235V, the high mode is set so that the relay 81 is connected to the first terminal 91*a* (step S2).

When it is determined that the terminal connected to the relay 81 is the second or third terminal 91*b* or 91*c* (step S3), due to load not generated yet when the linear compressor is initially operated, or the induced current generated in part of the coil 90 disconnected from the terminals, the linear motor 60 generates an excessive stroke. In order to prevent the generation of such an excessive stroke, the first terminal 91*a* is automatically connected to the second or third terminal 91*b* or 91*c* to form a closed circuit (step S4).

In succession, if a predetermined time passes after the linear compressor is operated, the load is generated due to a pressure difference between suction and discharge sides of the linear compressor. This naturally reduces the stroke, and thus cancels the connection of the short-circuited terminals, enabling normal operation of the linear compressor.

In this way, in order to substantially prevent an excessive stroke from being generated in the piston when the amount of current flowing in the coil 90 is abruptly changed upon receiving the power-supply voltage, the automatic short-circuit unit 82 short-circuits disconnected part of the coil, thereby preventing the excessive stroke from being generated as a result of such an abrupt transmission of the current during the initial operation stage of the linear compressor.

As apparent from the above description, the linear compressor and the method for controlling the same, in accordance with the present invention, utilizes the power-supply unit which is designed to provide the linear motor with a power-supply voltage, at the same time, to automatically short-circuit disconnected part of the coil during the initial operation stage of the linear compressor, and to cancel the automatic short-circuited status of the coil after the lapse of a predetermined time, such that it is possible to reduce noise caused by the excessive stroke generated during the initial operation time of the linear compressor, resulting in increased efficiency and convenience of the linear compressor.

Further, the linear compressor according to the present invention effectively prevents a collision problem between the piston and discharge vale included therein, advantageously increasing durability thereof.

Furthermore, according to the present invention, the stroke of the piston can be effectively controlled without requiring additional control parts, such that it is possible to reduce manufacturing costs of the linear compressor, resulting in a competitive price thereof.

Although the preferred embodiment of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A linear compressor comprising:

a piston contained in a cylinder, and executing rectilinear reciprocating motion to suck or discharge a refrigerant;

a linear motor for providing the piston with a driving power to allow the piston to execute the rectilinear reciprocating motion; and a power-supply unit for providing the linear motor with a power-supply voltage, and performing an automatic short-circuit function to prevent an excessive stroke from being generated during an initial operation stage of the linear motor.

2. The compressor as set forth in claim 1, wherein the linear motor includes:

a coil for creating a magnetic field of a predetermined magnitude in its peripheral area, upon receiving a current applied according to an entry mode; and a magnet connected to the piston, for executing the rectilinear reciprocating motion due to the magnetic field generated around the coil.

3. The compressor as set forth in claim 2, wherein the coil includes one or more terminals used to classify the coil into several parts according to a predetermined length for allowing the intensity of the magnetic field generated around the coil to be gradually changed according to the entry mode.

4. The compressor as set forth in claim 3, wherein the power-supply unit includes:

an AC (Alternating Current) power source for providing a commercial AC power-supply voltage; and a stroke controller for transmitting the AC power-supply voltage generated from the AC power source to a selected one of the terminals of the coil according to the entry mode, and short-circuiting one of the remaining terminals disconnected from the AC power source to the selected terminal during the initial driving stage of the linear motor.

5. The compressor as set forth in claim 4, wherein the stroke controller includes:

at least one relay connected to the selected terminal according to the entry mode; and an automatic short-circuit unit connected to the relay, for automatically short-circuiting one of the remaining terminals disconnected from the relay to the selected terminal in order to restrict the generation of an induced current in the coil.

6. The compressor as set forth in claim 5, wherein the automatic short-circuit unit, if the relay is connected to the selected terminal of the coil, automatically connects and short-circuits one of the remaining terminals, disconnected from the relay, to the selected terminal, and cancels the automatic short-circuited status of the terminals after the lapse of a predetermined time.

7. The compressor as set forth in claim 6, wherein the terminals consist of first to third terminals.

8. The compressor as set forth in claim 7, wherein the automatic short-circuit unit, if the relay is connected to the second terminal, automatically connects and short-circuits the second terminal to the first terminal, and automatically cancels the connection of the first and second terminals after the lapse of a predetermined time.

9. The compressor as set forth in claim 7, wherein the automatic short-circuit unit, if the relay is connected to the third terminal, automatically connects and short-circuits the third terminal to the first terminal, and automatically cancels the connection of the first and third terminals after the lapse of a predetermined time.

10. A method for controlling a linear compressor, comprising the steps of:

a) transmitting a power-supply voltage to the linear compressor designed to compress fluid, such as air and refrigerant gas, etc., and to discharge the compressed fluid; and b) automatically short-circuiting part of a coil having no power-supply voltage to form a closed circuit, in order to prevent an excessive stroke from being generated when the linear compressor is initially operated upon receiving the power-supply voltage.

11. The method as set forth in claim 10, wherein, in the step (b), if a second terminal, selected from among first to third terminals of the coil classified according to a predetermined length to gradually change the intensity of a magnetic field generated in the coil, is connected to a relay, the first terminal is automatically short-circuited to the second terminal, forming a closed circuit.

12. The method as set forth in claim 10, wherein, in the step (b), if a third terminal, selected from among first to third terminals of the coil classified according to a predetermined length to gradually change the intensity of a magnetic field generated in the coil, is connected to a relay, the first terminal is automatically short-circuited to the third terminal, forming a closed circuit.

13. The method as set forth in claim 10, further comprising the step of:

c), after performing the step (b), automatically canceling the automatic short-circuited status of the terminals after the lapse of a predetermined time.

14. The method as set forth in claim 10, wherein, in the step c), if load is generated due to a pressure difference between suction and discharge sides of the linear compressor, the short-circuited status achieved in the step b) is automatically canceled.

* * * * *